US006889520B2

(12) United States Patent
Sano et al.

(10) Patent No.: US 6,889,520 B2
(45) Date of Patent: May 10, 2005

(54) INTER-REGION THERMAL COMPLEMENTARY SYSTEM BY DISTRIBUTED CRYOGENIC AND THERMAL DEVICES

(75) Inventors: Makoto Sano, Tokyo (JP); Kuniaki Kawamura, Tokyo (JP); Junji Matsuda, Tokyo (JP); Katsumi Fujima, Tokyo (JP); Takanori Kudo, Tokyo (JP); Youichi Kawazu, Tokyo (JP); Choiku Yoshikawa, Tokyo (JP); Syuji Fukano, Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 0 days.

(21) Appl. No.: 10/416,487

(22) PCT Filed: Dec. 12, 2001

(86) PCT No.: PCT/JP01/10903

§ 371 (c)(1),
(2), (4) Date: May 13, 2003

(87) PCT Pub. No.: WO02/065034

PCT Pub. Date: Aug. 22, 2002

(65) Prior Publication Data

US 2004/0011074 A1 Jan. 22, 2004

(30) Foreign Application Priority Data

Feb. 16, 2001 (JP) ..... 2001-040425
Oct. 5, 2001 (JP) ..... 2001-310078

(51) Int. Cl.[7] ..... F25D 17/02; F25D 11/00; F25B 27/00

(52) U.S. Cl. ..... 62/434; 62/430; 62/435; 62/238.6; 62/437

(58) Field of Search ..... 62/430–435, 238.6, 62/437

(56) References Cited

U.S. PATENT DOCUMENTS 5,123,262 A * 6/1992 Laude-Bousquet ..... 62/434
5,139,549 A * 8/1992 Knodel et al. ..... 62/532
5,157,938 A * 10/1992 Bard et al. ..... 62/335
6,237,346 B1 * 5/2001 Ogoshi et al. ..... 62/4
6,415,628 B1 * 7/2002 Ahmed et al. ..... 62/534

FOREIGN PATENT DOCUMENTS

JP 56-52219 B2 12/1981
JP 10-259978 9/1998
JP 2000-146356 5/2000

OTHER PUBLICATIONS

Copy of International Search Report dated Mar. 19, 2002.

* cited by examiner

*Primary Examiner*—Denise L. Esquivel
*Assistant Examiner*—Filip Zec
(74) *Attorney, Agent, or Firm*—Crowell & Moring LLP

(57) ABSTRACT

The object of the invention is to provide a thermal complementary (combination of heat supply and heat discharge) system which can complement heat without the restriction of area of a region to be supplied with heat. An endless multiplex helical loop is formed to complement the heat produced in a region such as plants and regional facilities on a reciprocal basis, and the water is not circulated forcibly but achieves heat transfer in the helical loop.

Liquid or slurry-like water is sealed in the annular endless channel (endless loop) without forcibly circulated. Therefore, loop diameter of the annular endless channel, that means the area of the region, is not limited. The water forms temperature zones in the endless helical loop, the temperature being different per each component loop. Distributed cryogenic sources and thermal sources are thermally connected to said multiplex helical loop so that heat (i.e. water) can be taken in or discharged to or from said cryogenic or thermal sources. As the water needs not be forcibly circulated, the power for forcibly circulating the water is eliminated resulting in reduced running cost. Refrigerating apparatuses, heat source apparatuses, etc. distributed in the region are effectively utilized and also central control of energy supply through the multiplex helical loops is made possible.

19 Claims, 11 Drawing Sheets

INTER-REGION THERMAL COMPLEMENTARY SYSTEM BY DISTRIBUTED CRYOGENIC AND THERMAL DEVICES

FIELD OF THE INVENTION

The present invention relates to an inter-region thermal complementary system aiming the recovery and reuse of the heat emitted from plants and distributed cryogenic and thermal devices in a region, specifically to an inter-region thermal complementary system capable of complementing heat by forming an endless loop filled with water or slurry as heat source and heat sink.

TECHNICAL BACKGROUND

Energy policy has been under review on every level such as municipalities, corporations, and civilians in the viewpoint of preventing global warming.

In the field of electric energy, it has been proposed to eliminate the loss in electric power transmission and to raise energy efficiency by effectively utilizing waste heat by shifting from a large scale, which is centralized power plant system to a small scale electric power source dispersed in the region.

On the other hand, there are energy-saving technologies conducted by corporations such as co-generation and regional air conditioning. Further, recently, distributed small co-generation apparatuses such as micro gas turbines, fuel cells which are usable at the popular level such as housing complex and convenience stores are under development, which operate on town gas or natural gas.

Effort to improve the efficiency of these small apparatuses themselves is being continued, however, it is more than ever necessary to raise total energy efficiency as a whole region, that is, zero emission of heat is demanded.

For this reason, there has been developed several technologies to utilize the waste heat discharged from distributed air conditioning apparatuses for absorption or adsorption refrigerating machines after adjusting the temperature of the waste heat by heat-exchange with soil and the like to raise the coefficient of performance of individual air conditioning apparatus for raising energy efficiency as a whole district.

However, in most cases the excess in heat source systems is dissipated into the atmosphere in prior arts.

The excess heat in heat source systems used on citizen level such as distributed small scale co-generation apparatuses is difficult to be utilized, so the excess heat is discarded without utilized if there is no system for recovering and reusing the excess heat, and this promotes heat island phenomenon.

Heat emission from small apparatuses distributed over shopping districts or housing complex may increase, which is not assumed in the past, and it is demanded to effectively utilize the waste heat.

In the light of the problem mentioned above, there was a regional air conditioning system as a heat supplying system through regional piping. In the beginning, a 4-pipe method was adopted to supply hot water and cold water of temperatures demanded through exclusive going and returning pipes. Heat insulation of the pipes was necessary and effective utilization of the returning pipes was a problem.

As an improvement of the 4-pipe method was proposed a 2-pipe method in which each pipe is used for supplying or returning alternately according to seasons or time periods.

In Japanese Patent Publication No.56-52219, which mentions is disclosed an inter-region heat supplying system of 2-pipe method also discloses the art which improves the efficiency of individual device and energy efficiency as a whole region.

That is, according to the system, a plurality of heat pump type air conditioning apparatuses distributed over a plurality of places in a region and a power station having central co-generation apparatuses located at a place remote from said places, are connected with a cold water supplying pipe in summer time (the pipe is used as a return pipe in winter time) and a hot water supplying pipe (the pipe is used as a return pipe in summer time).

However, in the system, the two pipes are used for supplying and returning pipe alternately according to seasons by switching water flow by means of three-way valves, and the pipes do not constitute an endless loop as in the system according to the present invention described later. Therefore, a pump is needed for each of the supplying and returning sides, and the larger the amount of power to drive the pumps becomes, the further the distance of the region from the power station becomes.

To solve the problem, Japanese Patent Application Publication No.2000-146356 discloses a regional heating and cooling system in which inter-region piping is formed in a looped endless water passage, not in two going and returning pipes and distributed heat pumps with cryogenic heat accumulator are distributed in a region. That is, the looped endless water passage is of large capacity like a river flowing slowly through a region in order to keep the temperature of the water flowing in the passage as constant as possible.

According to the disclosure, as shown in FIG. 11, an inter-region piping 102 is buried underground to contact directly with the soil without insulation to permit heat-exchange between the water in the piping 102 and the soil, and the water is circulated in the piping 102 by means of a circulation pump 105. Heat pump apparatuses 101*a*, each having an ice heat accumulator, and heat pump apparatuses 101*b* without ice heat accumulator distributed over a region are connected with the piping by letting-in-and-out pipes 106. By thermally connecting the circulating water which exchanged heat with the soil to the ice heat accumulator or refrigerant condenser of the heat pump apparatus 101*a*, the heat the water absorbed from the refrigerant in the condenser or cryogenic heat the water absorbed in the evaporator of each heat pump apparatus is supplied to where they are needed. Preferably, a non-utilized heat sources U are thermally connected to the regional piping 102.

This prior art is different from Japanese Patent Publication No.56-52219 in the point that the regional piping 102 is an looped endless water channel, but the water which exchanged heat with soil is circulated in the regional pipe 102 by a circulation pump 105, so the circulation pump 105 is needed, which is different from the present invention in which does not require a water circulation pump. Furthermore, the capacity of the circulation pump must be increased as the area of the region increases. In other words, as the distance between the ice heat accumulator or refrigerant condenser of the heat pump apparatuses 101*a* and the place where the heat is used increases. Therefore, the area to be supplied with heat surrounded by the looped endless water channel is restricted.

SUMMARY OF THE INVENTION

The present invention was made in light of the problems mentioned above. The object of the invention is to provide a thermal complementary (combination of heat supply and discharge) system which can complement heat without the restriction of area of a region by forming an endless multiplex helical loop to complement the heat produced in a regional areas to each other without forcibly circulating the water in the helical loop with the water only achieving heat transfer thereto.

According to the invention, a tube formed in an substantially endless multiplex helical loop in which water such as water, a slurry with mixed ice and water (hereafter referred to as water) stays is laid in a region. The water in the helical loop forms a temperature zone of different temperature per each component loop without forcibly circulated therein. Distributed cryogenic sources and thermal sources are thermally connected to the helical loop to allow the water to bypass between each of the component loops forming different temperature zone so that the heat (i.e. the water) can be taken in or discharged to or from said cryogenic or thermal sources.

The features of the present invention are as follows:

First, the water staying in the helical loop is not forcibly circulated by a pump. As the water is not forcibly circulated in the helical loop but it only diffuses heat to achieve uniform distribution of heat in a component loop, a circulation pump is not needed as is the case in the prior art. This is the basic concept of the present invention.

As the helical loop is formed without providing a circulating pump, the diameter of the substantially endless helical loop, that means the area in which heat supply and discharge are performed is not limited and a helical loop of large diameter is possible to be formed.

Here, substantially endless loop includes the case the beginning end and termination end of the multiplex helical loop is connected to form a perfectly endless multiplex helical loop and the case a water tank straddles the component loops of the multiplex helical loop to be connected thereto.

Each component loop of the multiplex helical loop forms a temperature zone of a predetermined temperature.

To be more specific, in the case of duplex helical loop, a higher temperature zone is formed in a component loop and a lower temperature zone is formed in the other component loop of the duplex helical loop. In the case of triplex helical loop, the three temperature zones, higher, intermediate, and lower temperature zones are formed in the three component loops respectively.

In order for each loop to form temperature zones of the predetermined temperatures so that distributed cryogenic sources and thermal sources (thermal sources include refuge incinerators, waste heat boilers, ovens, etc. in addition to room heaters, hot water producers.) are thermally connected to bypass each two component loops forming different temperature zones of the multiplex helical loop and it is also necessary to thermally connect distributed cryogenic sources and thermal sources so that heat is taken in or discharged from the cryogenic source apparatuses and thermal source apparatuses from or to each component loop.

To be more specific, it is necessary that the distributed cryogenic source apparatuses take in cryogenic heat from the relatively lower temperature component loop side (hereafter referred to as lower temperature loop side) and discharge heat to the relatively higher temperature component loop side (hereafter referred to as higher temperature loop side) via heat exchangers, on the other hand, the distributed thermal source apparatuses take in heat from the relatively higher temperature loop side and discharge cryogenic heat to the relatively lower temperature loop side via heat exchangers, and the heat flow through the bypassing parts via the heat exchangers is one-way flow (the flow direction may change according to the seasons).

As a result, the discharging of heat from the distributed cryogenic source apparatuses and the taking-in of heat to the distributed heat source apparatuses are always done to and from the higher temperature loop side respectively, the taking-in of cryogenic heat to the distributed cryogenic source apparatuses and the discharging of heat from the distributed heat source apparatuses are always done from and to the lower temperature loop side respectively, and heat is diffused or complemented in each temperature zone, so thermal balance is achieved in each of the component loops having a higher temperature and a lower temperature zone respectively.

It is suitable that, an energy modulating section straddling the temperature boundary part of the multiplex helical loop to be connected thereto for bypassing the water between each component loop is provided, the modulation section being composed of a water tank, heat pump, and heat exchanger for modulating thermal unbalance of the component loops, and the relatively higher temperature loop side is connected to the upper part of the tank and the relatively lower temperature loop side is connected to the lower part of the tank.

The thermal complementary system can be constituted so that, a plurality of main helical loops are provided in a plurality of regions, each main helical loop is provided independently in each adjacent region where commercial, residential, and industrial district are located, and each main helical loop is thermally connected via an energy modulation section having a heat pump and heat exchanger to constitute a network of main loops.

Therefore, the invention is very practical, as a thermal complementary main helical loop can be provided first in a region prepared to accept the system, then another main helical loop can be provided in another region as the region is prepared to accept the system and this main helical loop can be connected with the existing main helical loop via an energy modulation section having a heat pump and heat exchanger to attain a network of main helical loops.

The present invention will further be explained herebelow.

The thermal complementary system of the present invention comprises a multiplex helical loop provided in a commercial district where buildings, shopping stores, convenience stores, apartments, etc. are concentrated, or in an industrial district where various kinds of factories are located, and is constituted so that heat is transferred and complemented efficiently between distributed refrigerating (cryogenic source) apparatuses and thermal heat source apparatuses by recovering the heat discharged from middle and small scale heat sources and supplying the recovered heat to the distributed cryogenic sources such as small refrigerating machines.

Each of the multiplex helical loop piping provided in a region is formed into a closed helical loop, and composed so that, absorption refrigerating machines for example, are operated by the heat of small scale discharged from distributed small heat source apparatuses which uses town gas or natural gas as fuel, the produced cryogenic heat is taken-in to the lower temperature loop side, and the cryogenic heat in the lower temperature loop is supplied to the distributed refrigerating (cryogenic source) apparatuses such as heat pumps for air conditioning, showcases, adsorption refrigerating machines connected to the lower temperature loop.

As the water is not circulated in the helical loop, only heat transfer by the water flowing through the bypass passage is performed, the power for circulating the water in the helical loop is not needed, and as cryogenic and thermal source (lower and higher temperature zones) are formed in the component loops separately, thermal conversion efficiency can be enhanced.

It is preferable that the heated water discharged from said distributed thermal source apparatuses is cooled by an absorption or adsorption refrigerating machine or heat pump and supplied to the relatively lower temperature loop according to the cooled temperature.

Each of the multiplex helical loops provided in each region is composed so that each component loop forms each temperature zone of different temperature and the taking-in and discharging of heat to and from the distributed cryogenic and thermal source apparatuses from and to the helical loop are performed through a bypass pipe, and giving and receiving of heat to and from the helical loop are done in correspondence with the temperature of the temperature zone of each component loop, so heat loss is reduced.

It is preferable that a connection part is provided to interchange heat between adjacent multiplex helical loops in the case when a plurality of multiplex helical loops are provided in a plurality of regions.

It is necessary that an energy modulation section for monitoring and modulating thermal balance of each multiplex helical loop is provided between adjacent multiplex helical loop because the temperature boundary between each component loop of a multiplex helical loop provided in a region may shifts according to the condition of heat usage in each region.

It is suitable that an energy modulation section for modulating thermal balance between multiplex helical loops is composed of a heat pump, a heat exchanger, and a water tank straddling the component loops, the relatively higher temperature loop being connected to the upper part of the tank and the relatively lower temperature loop being connected to the lower part of the tank.

When the distributed refrigerating apparatuses are operated utilizing the multiplex helical loop provided with an energy modulation section, in the case of an air conditioner for example, lower temperature water is taken out from the lower temperature loop to be used for cooling the refrigerant in the condenser and the discharged water which is raised in temperature in the condenser is returned to the higher temperature loop in summertime when the air conditioner is used as a cooler, and in wintertime when the air conditioner is used as a heater, higher temperature water is taken out from the higher temperature loop to be used for absorbing the latent heat of the refrigerant, i.e. to be used for heating the refrigerant in the evaporator and discharged water which is lowered in temperature in the evaporator is returned to the lower temperature loop 12.

As a result, in the case of said air conditioner, an almost even temperature zone is maintained in each of said two component loops of higher and lower temperature although the temperatures therein fluctuate in some degree, and a balanced state of heat is maintained.

When there are many distributed apparatuses operated as refrigerating machines which use cryogenic source, the amount of water taken out from the lower temperature loop increases and thermal unbalance develops between the lower temperature loop (here unbalance means that the temperature difference between each component loop is excessively higher or lower than a determined range.). To keep the balance between the component loops (here balance means that the temperature difference between each component loop is in a determined range.), waste heat is recovered from other apparatuses to operate absorption or adsorption refrigerating machines, etc. for producing cryogenic heat (low temperature water), and the cryogenic heat is supplied to the lower temperature loop to maintain thermal balance between each component loops.

Therefore, with the constitution of the invention described above, taking-in and discharging of heat can be performed by using two or more component loop having each always constant temperature zone, so that air conditioners can be downsized compared with conventional air conditioners each of which has a separate refrigerating apparatus of air or water cooled type. In addition, coefficient of performance (COP) can be raised by lowering the outlet temperature of refrigerant from the condenser, and as the water needs not be forcefully circulated in the loops, the power for circulating the water is substantially eliminated.

In the case a duplex helical loop is composed of a lower temperature loop of 20° C. and a higher temperature loop of 25° C., the temperature difference being 5° C., the temperatures of the water is near atmospheric temperature and less influenced by the atmospheric temperature. When an air conditioner is operated as a cooler, if the refrigerant is cooled in the condenser by using the water of 20° C. of the lower temperature loop, COP of the air conditioner is doubled compared to the case it is cooled to 50° C. by air cooling.

When cryogenic heat of 20° C. is produced by an absorption refrigerating machine, if the water of 20° C. in the lower temperature loop is used, COP rises from 0.7 to 1.0 in the case of a single effect absorption machine and from 1.2 to 1.5 in the case of a double effect absorption machine. When cryogenic heat of 20° C. is produced by an adsorption refrigerating machine, COP rises from 0.6 to 0.8.

It is preferable in the inter-region thermal complementary system of the present invention that, as main purpose of the system is for air conditioning, a duplex helical loop which has two temperature zones of 20° C. and 25° C. is formed as an ordinary temperature main helical loop and a plurality of the duplex helical loops are connected to form a network of helical loops.

When the helical loop is applied to food factories, it is suitable that a sub-helical loop is formed which has temperature zones of 0° C.~15° C. by taking out the water in said ordinary temperature main helical loop and cooling it by utilizing the heat conversion function of an absorption or adsorption refrigerating machine to feed to the sub-helical loop to enhance thermal efficiency, for temperatures of 0° C.~40° C. is needed in food factories. To be more specific, it is suitable that a duplex helical loop having two temperature zones of temperature difference of about 5° C. is formed by filling water of about 0° C.~7° C. in the lower temperature loop and water of about 5° C.~15° C. in the higher temperature loop by using a heat conversion means, and the sub-helical loop is connected to said ordinary temperature main helical loop via an energy modulating means which allows heat transfer between the two helical loops.

Said main helical loop may be laid without trouble in a corporate premises such as in the area of factories, it is suitable in a region where a conflict-of-interest between the commercial district and industrial district exists that a main helical loop is laid in every region where negotiation is settled between interested parties and each main helical loop is thermally connected in series and/or in ramified state via an energy modulation section in which the movement of heat between each main loop is performed.

When said ordinary temperature main helical loop is laid in each of a plurality of regions and thermally connected in series and/or in ramified state via an energy modulation section in which the movement of heat between each main loop is performed, heat can be transferred from a main helical loop to an adjacent main helical loop without the need for a circulation pump.

The constitution like this is advantageous in the point of view of heat transfer. For example, cryogenic heat (lower temperature water) can be transferred from the main helical loop which is provided in a region where electric power generation plants and industrial complexes, etc. are located and has ample cryogenic source to the main helical loop provided in a commercial district where cryogenic source is insufficient via the main helical loop provided in an intermediate industrial district, by utilizing the heat conversion function of the energy modulation sections provided between each main helical loop, and thermal balance of each main helical loop can be achieved.

It is suitable that, the thermal connection of said main helical loops is performed such that satellite helical loop group are provided around a central main helical loop and thermally connected via energy modulation sections which perform heat transfer between each main helical loop, or another main helical loop or satellite helical loop group is thermally connected to said satellite helical loop groups, and central control is performed by forming a plurality of network loops through connecting a variety of distributed factories, cryogenic and thermal sources distributed in commercial and apartment districts, and distributed refrigerating apparatuses in buildings, etc.

It is suitable that a main- and sub-multiplex helical loop are provided in a region and the both helical loops are thermally connected via an energy modulation section which performs heat transfer between them.

In a region where food processing industries which perform mainly low temperature processing are included, a sub-helical loop having temperature zones different in temperature from the ordinary temperature main helical loop may be thermally connected to the main helical loop which performs the supply of heat over whole region, via an energy modulation section.

Concerning the temperature control of the sub-helical loop, the supply of lower temperature cryogenic source water is performed by means of the heat conversion function of an absorption or adsorption refrigerating machine, the supply of higher temperature thermal source water is performed by a heat pump, and the thermal connection of the main- and sub-helical loop is performed by a heat exchanger or heat pump.

DETAILED DESCRIPTION OF THE PREFERRED EMBODIMENT

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
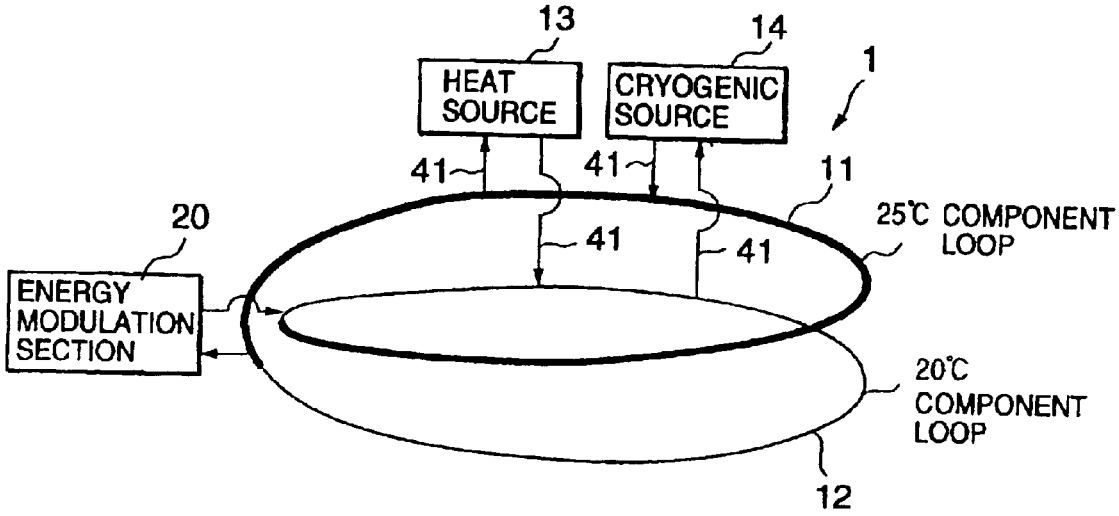
FIG. 1 is a basic block diagram of the inter-region thermal complementary system according to the present invention in the case the beginning end and termination end of a multiplex helical loop is connected to form a perfect endless multiplex helical loop, (A) shows the case of duplex helical loop, and (B) shows the case of triple helical loop.
Figure 1:
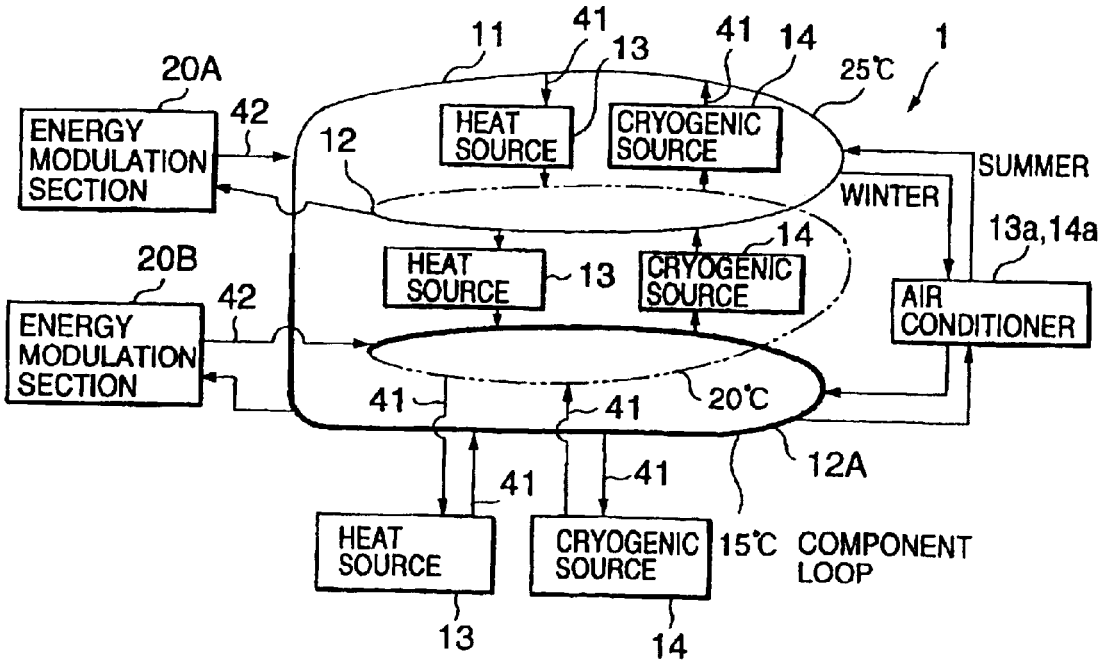

FIG. 1 is a basic block diagram of the inter-region thermal complementary system according to the present invention. A duplex helical loop (pipe)1 is buried under the surface of roads and grounds of housing, commercial or industrial complexes the duplex helical loop being formed by turning a pipe in two turns in an endless duplex loop and water being filled in it. In FIG. 1(A), distributed refrigerating apparatuses (distributed cryogenic source) 14 and distributed heat source apparatuses 13 (distributed heat source) are connected to the loop so that the water on the lower loop 12 is kept to a relatively low temperature of about 20° C. and the water in the upper loop 11 is kept to higher temperature of about 25° C.

The water in the helical loop is not circulated by a pump but stayed in the loop. Therefore, heat is not transferred in the loop by water circulation. The water temperature of one loop zone is different from that of the other loop zone.

The refrigerating apparatuses 14 and heat source apparatuses 13 are thermally connected to said two component loops so as to form a bypass passage 41 (bypass circuit) between the component loops, and the taking-in or discharging of cryogenic heat or hot heat from or into the zone of a component loop 11 or the zone of the other component loop 12, is performed.

To be concrete, the distributed cryogenic sources 14 such as distributed refrigerating air conditioning apparatuses take in cryogenic heat from the relatively lower temperature loop 12 and discharge its waste heat to the higher temperature loop side 11, on the other hand, distributed heat sources 13 such as distributed heat source apparatuses take in heat from relatively higher temperature loop side 11 and discharges its waste heat to the lower temperature loop side 12. The heat flow in each bypass circuit is of one-way flow between the two loops.

As a result, the discharging of the waste heat from the distributed cryogenic source 14 and taking-in of heat from the distributed heat source 13 are always done to or from the higher temperature loop side 11, and the taking-in of cryogenic heat from the distributed cryogenic source 14 and the discharging of cryogenic heat from the distributed heat source 13 are always done from or to the lower temperature loop side 12.

Therefore, the thermal balance in each of the two component loops of relatively higher and lower temperature is attained, for thermal diffusion and supplementation are performed in the loop zone of 20° C. and that of 25° C. separately.

A heat source energy modulation section 20 (heat pump or heat exchanger) is provided at the boundary parts of the two temperature zones and a bypass passage 42 connect the modulation section 20 to each boundary part for modulating the temperature of the zones when thermal unbalance has developed between the component loops 11 and 12. For example, the modulating section 20 takes out part of the water in the zone of 25° C. to cool it to 20° C. and send back to the zone of 25° C. or takes out part of the water in the zone of 20° C. to heat it to 25° C. and send back to the zone of 20° C.

The number of the component loop 12, 11 can be arbitrarily decided. For example, in FIG. 1(B), it is suitable to provide a triplex loop composed of three turns of loop, in which the lowest loop 12A forms a zone of 15° C., intermediate loop 12 forms a zone of 20° C., and the top loop 11 forms a zone of 25° C.

In this case, when the distributed air conditioner 13*a*, 14*a* are apparatuses which need cryogenic heat in summer time and heat in winter time, it is suitable to make bypass connection between the lower temperature loop 12A of 15° C. and the higher temperature loop 11 of 25° C. When they are apparatuses which need always 20° C.~25° C. as in constant temperature rooms or hospitals, it is suitable to make bypass connection between the intermediate temperature loop 12 of 20° C. and the higher temperature loop 11 of 25° C. When they are apparatuses which need always 15° C.~20° C. such as air conditioners in skating rinks, it is suitable to make bypass connection between the lower temperature loop 12A of 15° C. and the intermediate temperature loop 12 of 20° C.

In this case, an energy modulation section (heat pump or heat exchanger) 20 is provided between the lower temperature loop 12A of 15° C. and intermediate temperature loop 12 of 15° C., and an energy modulation section 20A is provided between the intermediate temperature loop 12 of 20° C. and higher temperature loop 11 of 25° C.

Figure 2:
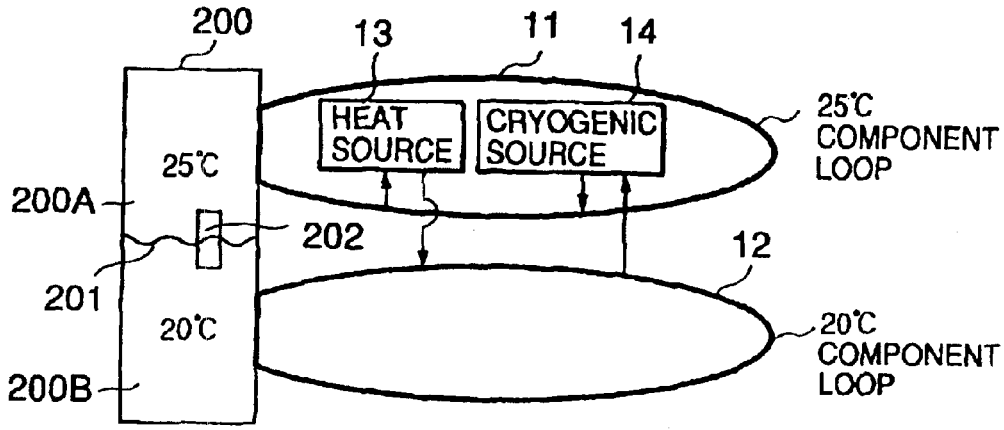
FIG. 2 is a basic block diagram of the inter-region thermal complementary system according to the present invention in the case a water tank straddles loops, (A) shows the case of the duplex helical loop, and (B) shows the case of the triple helical loop.
Figure 2:
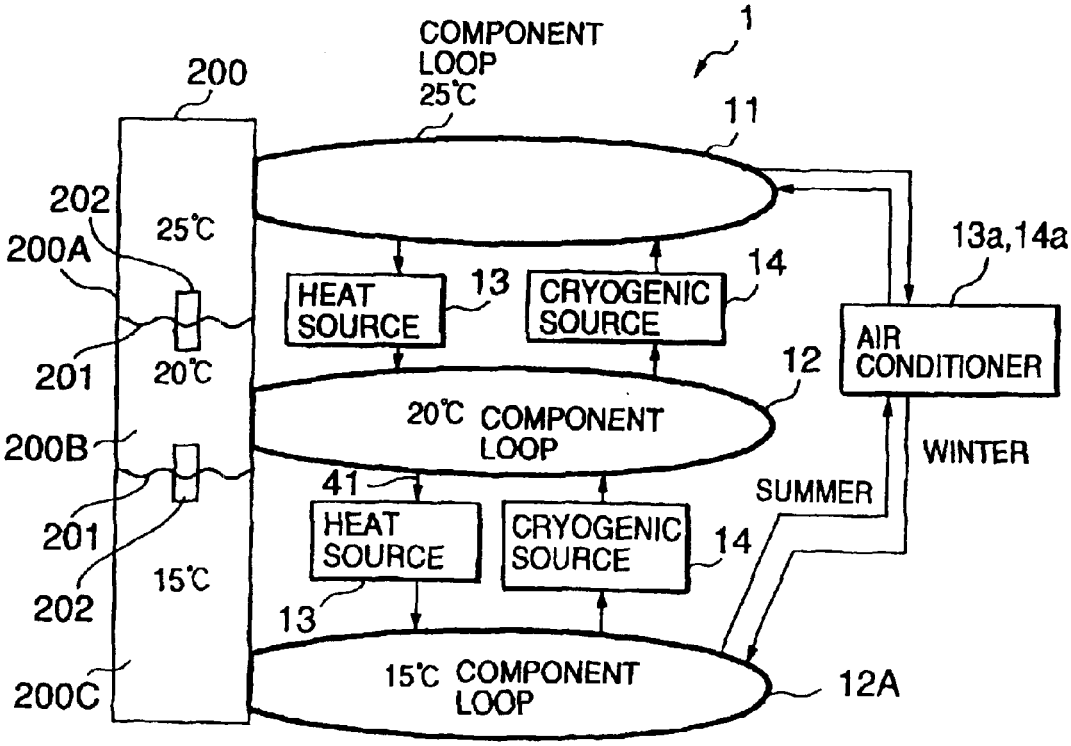

FIG. 2 is another embodiment in which an energy modulation section is formed as a water tank 200, and the multiplex helical loop is configured in the form of parallel loops. In the case of duplex helical loop, an upper component loop 11 forming a relatively higher temperature zone and lower component loop 12 forming a relatively lower temperature zone are provided as shown in FIG. 2(A). In the case of triple helical loop, three parallel component loops 11, 12, and 12A, each forming a zone of higher temperature, intermediate temperature, and lower temperature respectively as shown in FIG. 2(B).

In order to keep each zone to nearly a constant temperature, it is necessary to thermally connect distributed cryogenic source 14 and heat source 13 to two component loops of different temperature of the multiplex helical loop via a bypass pipe 41 to allow the taking-in and discharging of cryogenic heat or heat from a temperature zone and to the other temperature zone as mentioned before.

As a result, the discharging of the waste heat from the distributed cryogenic source 14 and the taking-in of heat from the distributed heat source 13 are always done to or from a higher temperature loop side through the bypass pipe 41, and the taking-in of cryogenic heat from the distributed cryogenic source 14 and the discharging of cryogenic heat from the distributed heat source 13 are always done from or to a component loop lower in temperature through the bypass pipe 41, and the thermal balance in each of the component loops 11, 12, 12A forming zones different in temperature is attained, for thermal diffusion and supplementation are performed in the loop zones separately.

In the case of duplex loop shown in FIG. 2(A), the relatively higher temperature loop 11 of 25° C. is connected to the tank 200 at upper part 200A in which the water temperature is about 25° C., and the relatively lower temperature loop 12 is connected to the tank at lower part 200B in which the water temperature is about 20° C. When thermal unbalance has developed between the component loops 11 and 12, modulation of thermal balance is done by the change of temperature distribution due to the difference of specific gravity of water according to its temperature.

That is, as shown in FIG. 2(A) when the heat discharged to the upper loop of 25° C. is excessive, the boundary 201 between the temperature zone of 25° C. and 20° C. falls downward, when the cryogenic heat discharged to the lower loop of 20° C. is excessive, the boundary 201 between the temperature zone of 25° C. and 20° C. rises upward, and the boundary 201 is monitored by a sensor 202.

Distributed cryogenic sources 14 may be heat pumps for air conditioning or refrigerating apparatuses used for freezing or condensing in factories, for example. A heat accumulation tank not shown in the drawing may be provided in the duplex helical loop 1 for effective heat controlling through the four seasons.

In the case of triplex helical loop shown in FIG. 2(B), it is possible that distributed cryogenic/heat sources 13*a*, 14*a* such as air conditioners take in heat from the higher temperature loop side 11 in the winter season and take in cryogenic heat for condensers from the lower temperature loop side 12A in the summer season for the air conditioning of individual stores, department stores, individual houses, and buildings. Two bypass pipe may be provided for the heat sources 13*a*, 14*a*, or one bypass pipe may be used by switching the water flow according to the seasons.

In FIG. 1(B) and FIG. 2(B), the air conditioners 13*a*, 14*a* receive higher temperature water of 25° C. from the higher temperature loop side 11 through the bypass pipe 41 to produce heating source and return the cooled waste heat to the lower temperature loop side 12A in the winter season. In the summer season, they receive lower temperature water of 15° C. from the lower temperature loop side 12A through the bypass pipe 41 for cooling source and return the waste heat to the higher temperature loop side 11. As a result, the cryogenic source in the lower temperature loop 12A decreases and the thermal source in the higher temperature loop side 11 increases, thus the heat transfers in the multiplex helical loop from the lower temperature loop side 12A to the higher temperature loop side 11.

As the sum of the heat energy of higher temperature loop side 11 and lower temperature loop side 12A is always kept constant, an about equal standard amount of heat is held by the heat source water in the higher and lower temperature loop 11, 12A in intermediate seasons when air conditioning is not done.

The waste heat from refuge incinerators, factories, co-generation system of mini electric power plant is received through the bypass pipe 41. The waste heat from these heat sources is utilized for operating, for example, absorption or adsorption refrigerating machines and cryogenic heat of 15° C. obtained from the machines is supplied to the lower temperature loop side 12A as necessary.

An energy modulation section is provided to the multiplex helical loop 1 and a heat pump is located therein, as described before, to complement the shift of heat balance developed due to heating and cooling operation of air conditioners.

When cooling, the cryogenic heat is taken in from the lower temperature loop side 12A through the bypass pipe 41 and the waste heat is returned to the higher temperature loop side 11, so the cryogenic source in the lower temperature loop side 12A decreases and the thermal source in the higher temperature loop side 11 increases. The increased thermal source is cooled by the heat pump and returned to the lower temperature heat source side to achieve thermal balance of the both sources.

When heating, the thermal source is taken in from the higher temperature loop side 11 and the cryogenic heat generated is returned to the lower temperature loop side 12A, so the thermal source decreases and the cryogenic source increases. The increased cryogenic source is heated by the heat pump and returned to the higher temperature heat source side to achieve thermal balance of the both sources.

Figure 3:
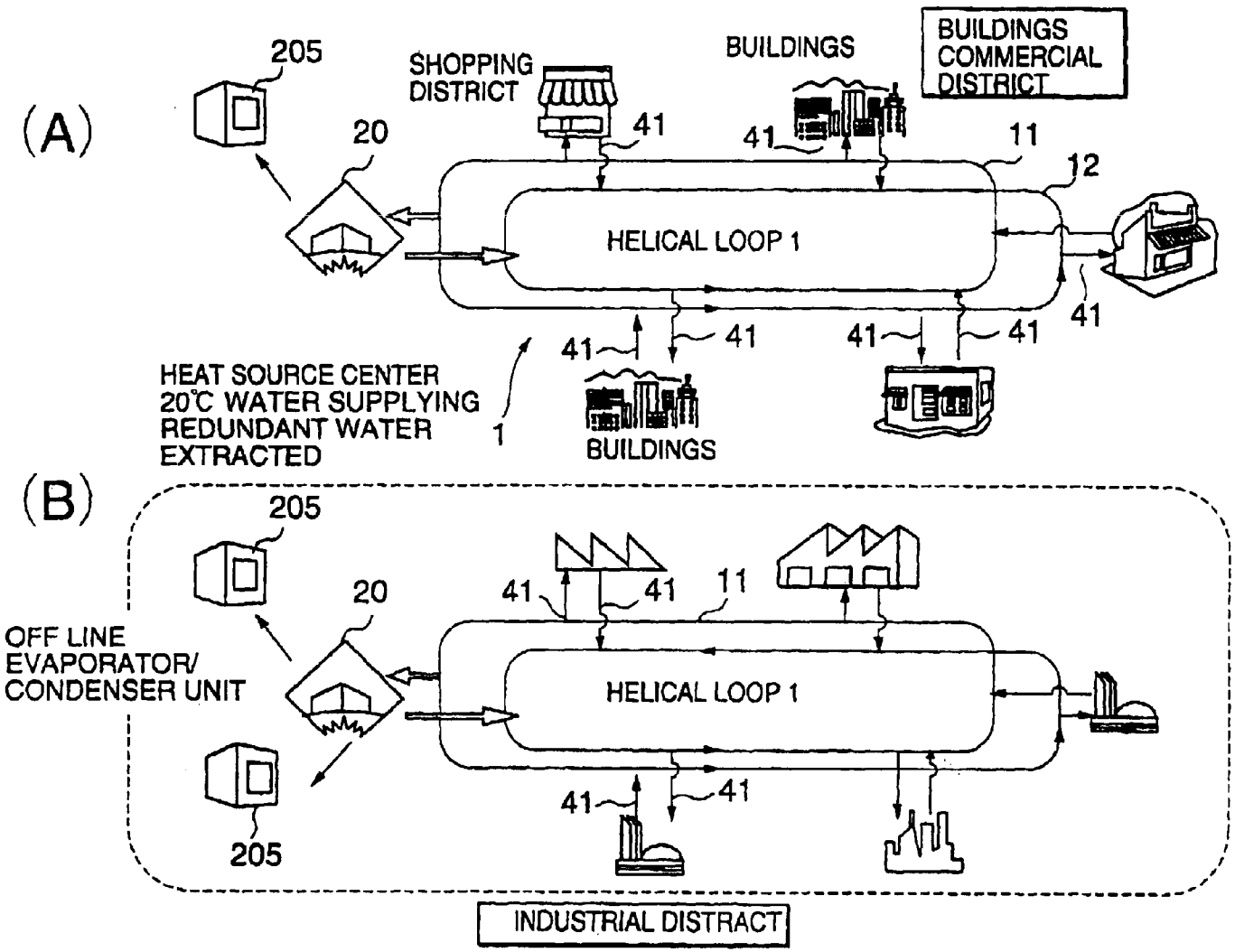
FIG. 3 is an embodiment of the case the inter-region thermal complementary system according to the present invention is established in a region, (A) shows the case of a business district, and (B) shows the case of an industrial district.

FIG. 3 is an embodiment of the case the inter-region thermal complementary system according to the present invention is established in a region, (A) shows the case in a business district, and (B) shows the case in an industrial district.

As seen in FIG. 3(A), the inter-region thermal complementary system according to the invention is provided in a business district where are located facilities such as buildings, shopping stores, convenience stores, apartments and in these facilities are provided distributed refrigerating apparatuses 14 such as heat pumps for air conditioning, cooling apparatuses of showcases, absorption refrigerating machine, and distributed heat source apparatuses 13 such as micro gas turbines, fuel cells of out put of about 30~80 KW.

A duplex helical loop 1 formed of an endless pipe turned in two turns is buried underground between the facilities.

In the embodiment, water of relatively lower temperature of 20° C. is filled in the lower component loop 12, the first turn, and water of relatively higher temperature of 25° C. is filled in the upper component loop, the second turn. The water staying in the helical loop 1 is not circulated by a pump and each loop forms a zone of different temperature.

Each of the distributed refrigerating apparatuses 14 and distributed heat source apparatuses 13 are thermally connected to the two component loops through the bypass pipe 41, and the taking-in and discharging of cryogenic or heat are performed.

An energy modulation section (heat pump 201 and heat exchangers) is provided bypassing the multiplex helical loop to modulate thermal unbalance when it develops between the component loops. Excess water of 25° C. in the component loop 11 is taken out and cooled to 25° C. to be returned to the component loop 12 of 20° C., for example.

The number of the component loops 12, 11 can be arbitrarily decided. For example, it is suitable to provide a triplex loop composed of three turns of loop, in which the lowest loop 12A forms a zone of 15° C., intermediate loop 12 forms a zone of 20° C., and the top loop 11 forms a zone of 25° C.

FIG. 3(B) is an embodiment in the case of an industrial district. Each of the distributed refrigerating apparatuses 14 and distributed heat source apparatuses 13 are thermally connected to the two component loops through the bypass pipe 41, and taking-in and discharging of cryogenic or heat are performed.

The energy modulating section 20 is connected to an evaporator/condenser unit 205. The modulation section 20 receives or supplies heat from or to the evaporator/condenser unit 205. For example, the modulation section 20 takes in excess water of 25° C. from the component loop 11 and cool it to 20° C. to return to the component loop 12 of 20° C. or takes in excess water of 20° C. from the component loop 12 and heat it to 25° C. to return to the component loop 11 of 25° C.

Figure 4:
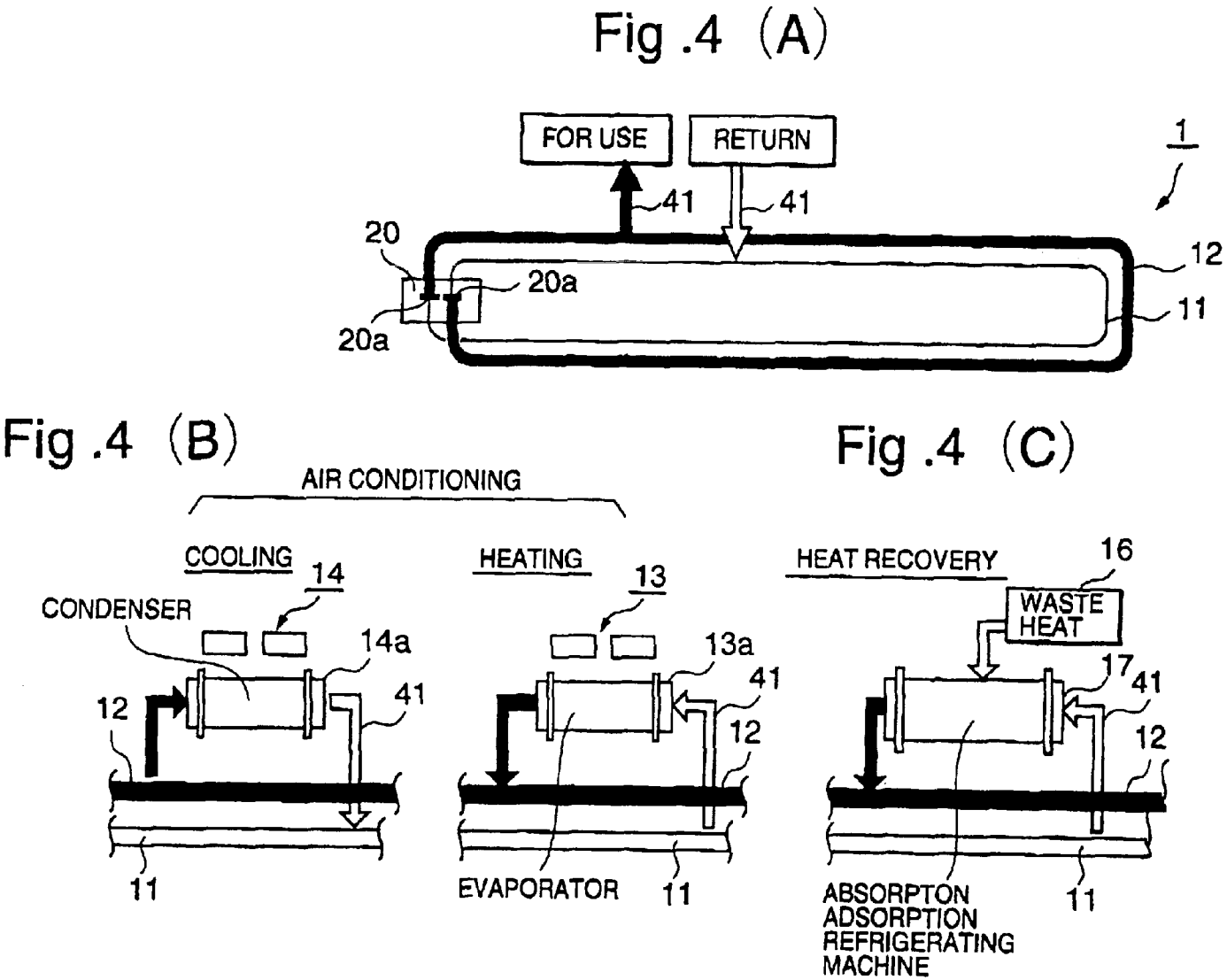
FIG. 4 is an illustration for explaining the basic concept of the second invention of the inter-region thermal complementary system according to the present invention, (A) shows a schematic block diagram, (B) shows the delivery and acceptance of heat when an air conditioner is operated using the thermal and cryogenic source water supplied through the duplex helical loop of (A), and (C) shows the case of supplying cryogenic source water by heat recovery.

FIG. 4 is an illustration for explaining the duplex helical loop 1, (A) shows a schematic block diagram, (B) shows the delivery and acceptance of heat when an air conditioner is operated using the thermal and cryogenic source water supplied through the duplex helical loop of (A), and (C) shows the case of supplying cryogenic source water by heat recovery.

As seen in FIG. 4(A), thermal source and cryogenic source of proper temperatures are filled in the higher temperature loop 11 and lower temperature loop 12 of the duplex helical loop 1 respectively, and the beginning end of the component loop 11 is connected with the termination end of the component loop 12 to form an endless duplex helical loop 1 in an inter-region thermal complementary system with distributed refrigerators and distributed heat sources distributed in the loop line system.

The supply of heat in the region through the receiving and supplying of heat from and to the duplex helical loop of different temperature is shown in FIG. 4(B).

When cooling, as seen in the case of cooling in FIG. 4(B), the heat source water of lower temperature is taken up from the lower temperature loop side 12 through the bypass pipe 41 as shown by a thick black-arrow to be used for cooling the condenser 14*a* of the distributed cryogenic source 14 which functions as a cooler, and the heated water by cooling the condenser 14*a* is returned to the higher temperature loop side 11 as shown by a hollow arrow. As a result, the amount of lower temperature heat source water in the lower temperature loop 12 decreases by the amount used, the amount of higher temperature heat source water in the higher temperature loop 11 increases by said amount, and the total amount of the heat source water does not change but the position of the temperature boundary 20*a* shifts.

When heating, as seen in the case of heating in FIG. 4(B), the heat source water of higher temperature is taken up from the higher temperature loop side 12 through the bypass pipe 41 as shown by a hollow arrow to be used for absorbing the latent heat of the refrigerant in the evaporator 13*a* of the distributed heat source 13 which functions as a heater, and the water cooled by the evaporator 13*a* is returned to the lower temperature loop side 12 as shown by a thick black-arrow. As a result, the amount of higher temperature heat source water in the higher temperature loop 11 decreases by the amount used, the amount of lower temperature heat source water in the lower temperature loop 12 increases by said amount, and the total amount of the heat source water does not change but the position of the temperature boundary 20*a* shifts.

An energy modulation section 20 is provided to monitor the shift of the position of the temperature boundary, and when the change of thermal balance develops above a certain limit, heat or cryogenic heat is supplied to the loops by a absorption or adsorption refrigerating machine 17 to correct the shift of the position of the temperature boundary.

The supply of cryogenic heat to the lower temperature loop side 12 by using said absorption or adsorption refrigerating machine 17 as a temperature balance correcting means is illustrated in FIG. 4(C).

As seen in FIG. 4(C), the absorption or adsorption refrigerating machine 17 which has heat conversion function operated by using waste heat 16 is used, and lower temperature heat source water is obtained by the refrigerator 17 from the water in the higher temperature loop 11 to be returned to the lower temperature loop side 12 through the bypass pipe 41, thus the thermal balance in the helical loop is attained by using waste heat 16.

As described above, the heat discharged from the heat sources apparatuses distributed in a region is recovered to the duplex helical loop of the present invention. The heat obtained by heat conversion is sealed in the higher and lower temperature component loop 11, 12 of the duplex helical loop 1 laid in a region and the distributed cryogenic source apparatuses 14 located along the helical loop are operated through receiving giving of heat between the component loops via bypass pipes, Therefore, regional supply of heat is possible without the need for the power to circulate cryogenic and thermal heat source water in the looped water channel.

Figure 5:
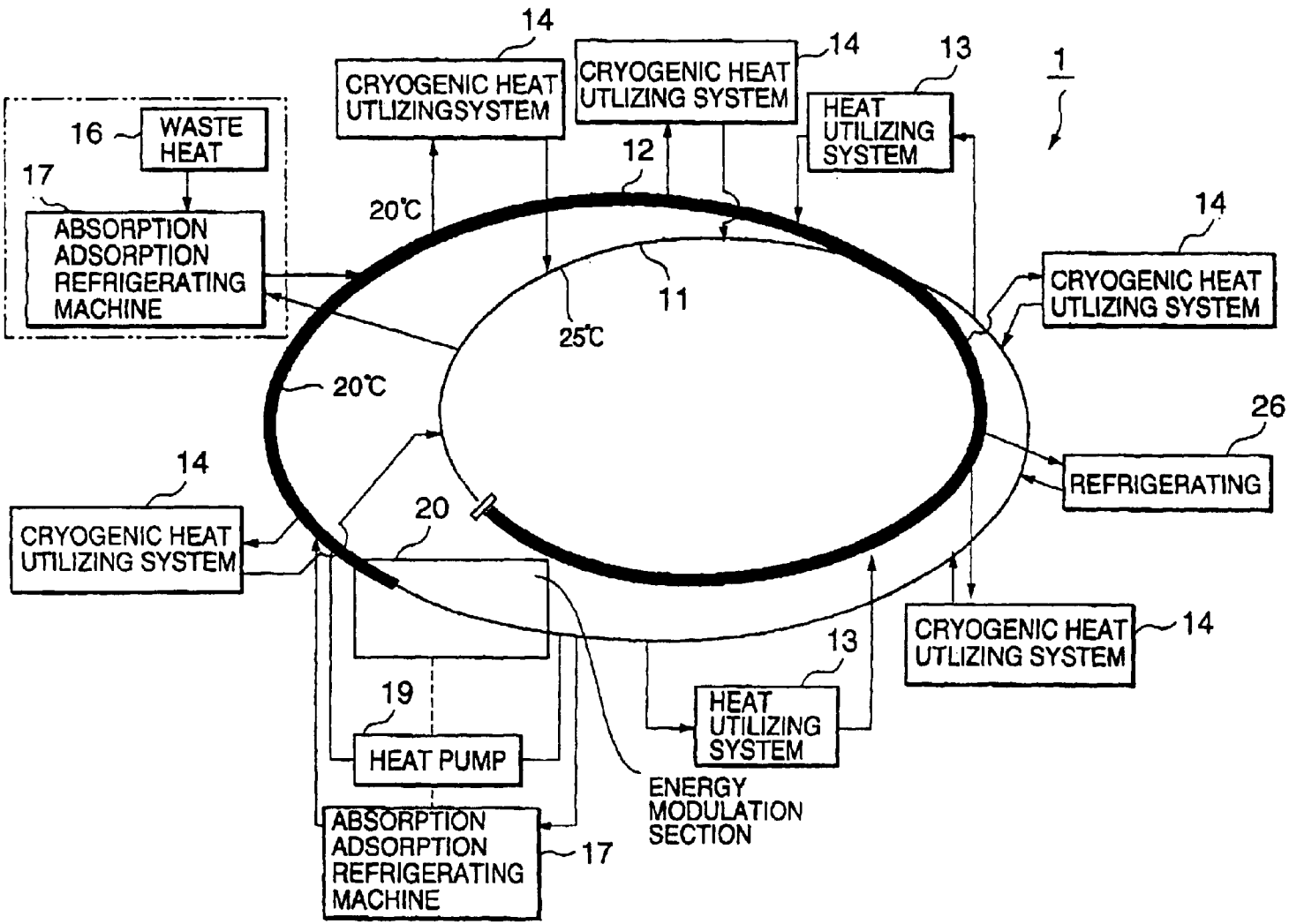
FIG. 5 is a schematic block diagram of the inter-region thermal complementary system of FIG. 4.
Figure 6A:
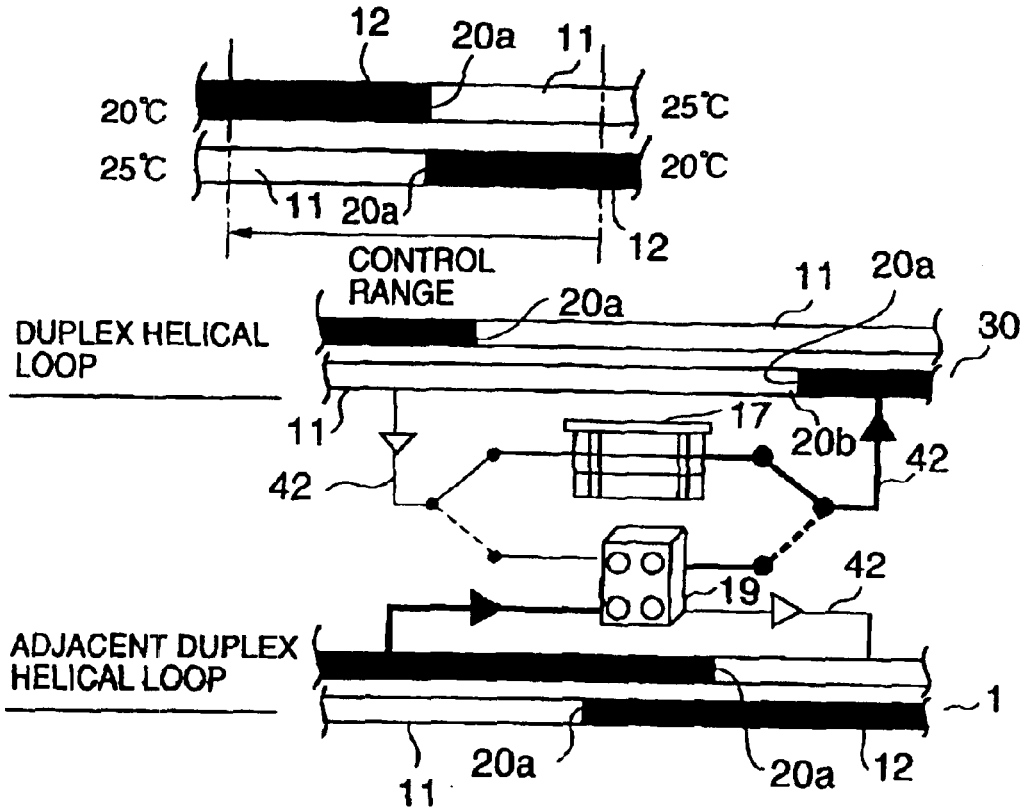
FIG. 6(A) is an illustration showing the working of the energy modulation section of FIG. 5.
Figure 6B:
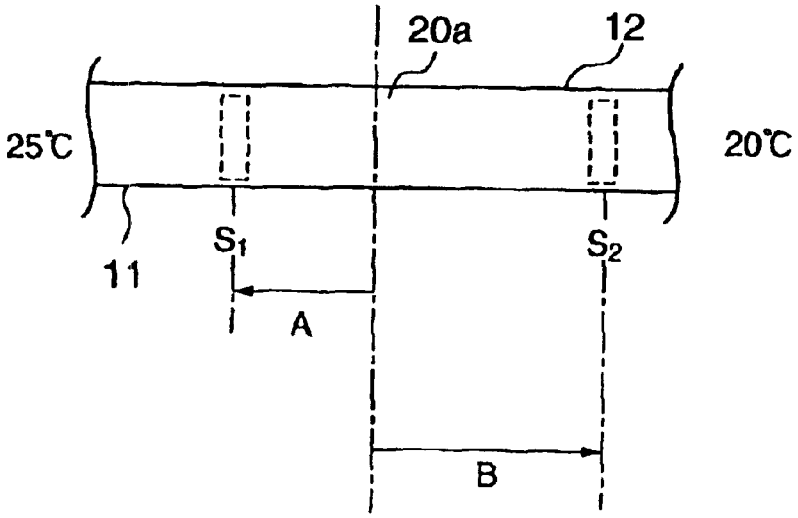
FIG. 6(B) is an illustration showing an unbalance detecting method used for the modulation in FIG. 6(A).

FIG. 5 is a schematic block diagram of the inter-region thermal complementary system of FIG. 4, and FIG. 6(A) is an illustration showing the working of the energy modulation section of FIG. 5, and FIG. 6(B) is an illustration showing an unbalance detecting method used for the modulation in FIG. 6(A).

Said energy modulation section 20 is connected to the duplex helical loop 1 with a bypass pipe 42 so that the modulation section 20 straddles the beginning end of the higher temperature loop 11 and the termination end of the lower temperature loop 12 as shown in FIG. 6(A),(B). Temperature boundaries 20*a* exist at each end. As shown in FIG. 6(B), the shift of each temperature boundary 20*a* is detected by temperature sensors $S_1$ and $S_2$ located at both sides of each temperature boundary 20*a*, and a heat pump 19 is operated to achieve the thermal balance of the higher and lower temperature loop side 11 and 12.

As seen in FIG. 6(B), when the temperature boundary 20*a* shifts in the direction of arrow A, the sensor $S_1$ detects the increase of the amount of lower temperature source water, and when it shifts in the direction of arrow B, the sensor $S_2$ detects the increase of the amount of higher temperature source water. The thermal balance is achieved in correspondence with said amount of increase.

Figure 9:
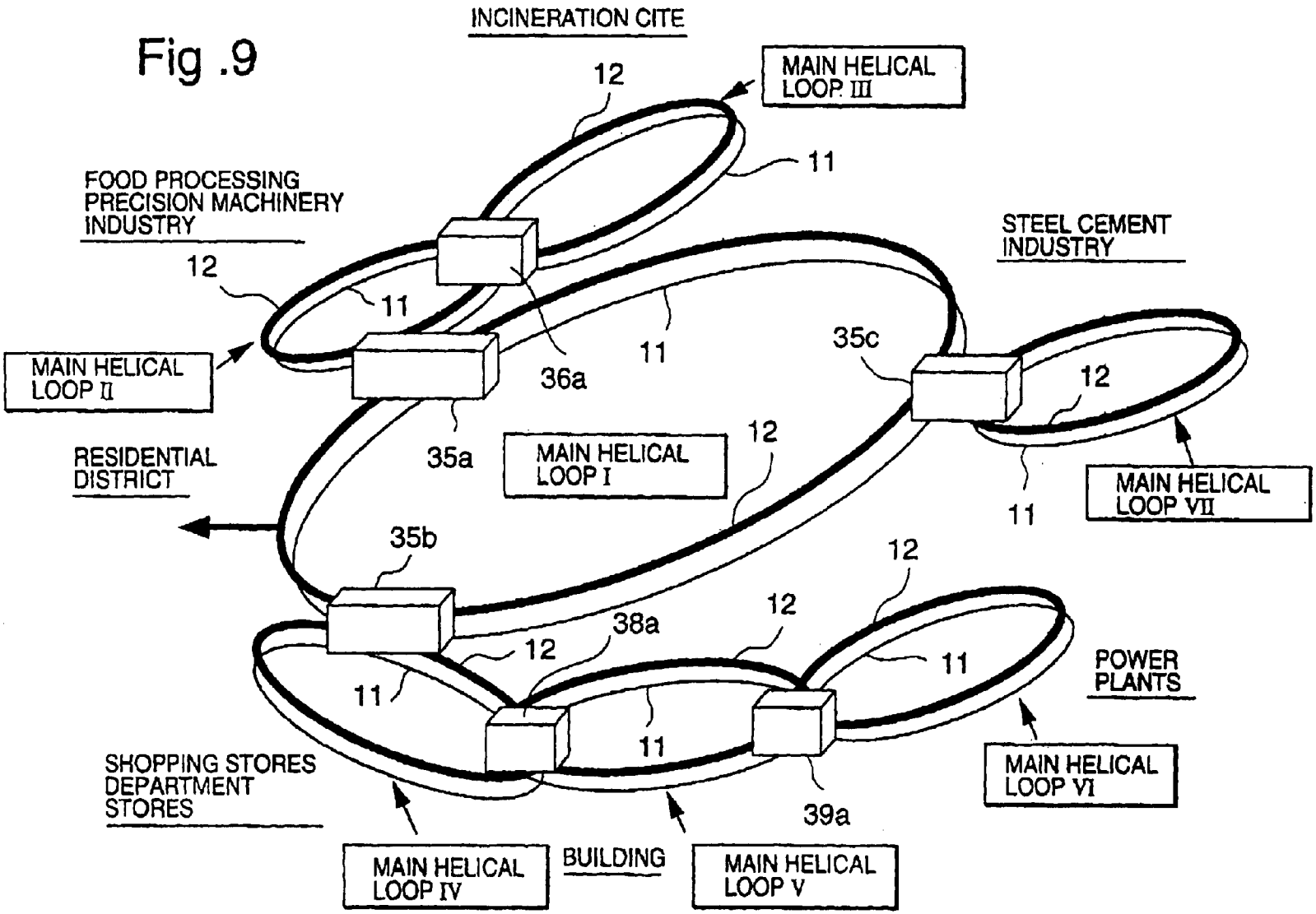
FIG. 9 is an embodiment of the inter-region thermal complementary system of FIG. 5 in the case the target region is extended.
Figure 10:
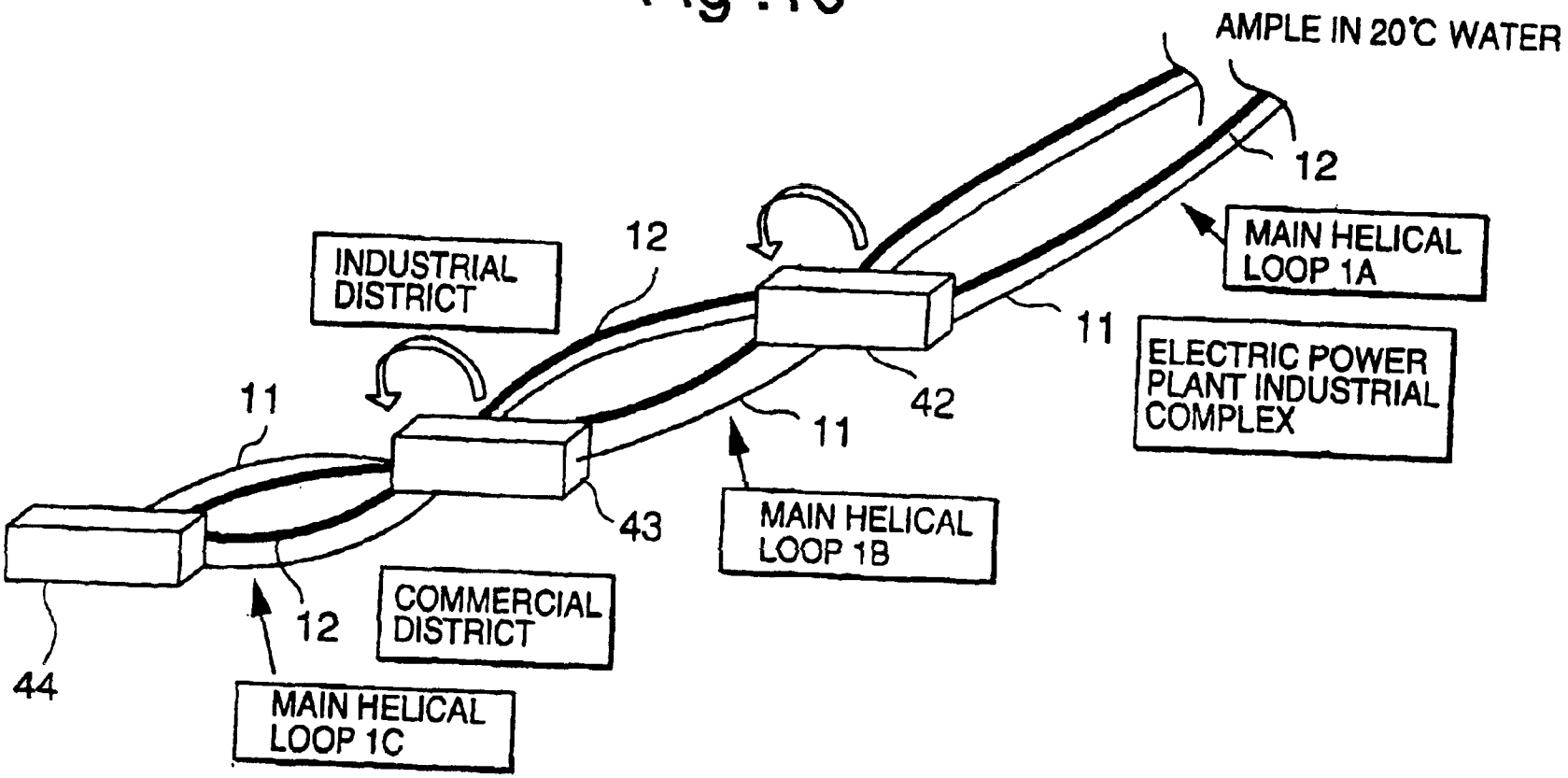
FIG. 10 is an illustration of the case a plurality of regional duplex helical loop of the inter-region thermal complementary system of FIG. 5 are connected in series.
Figure 11:
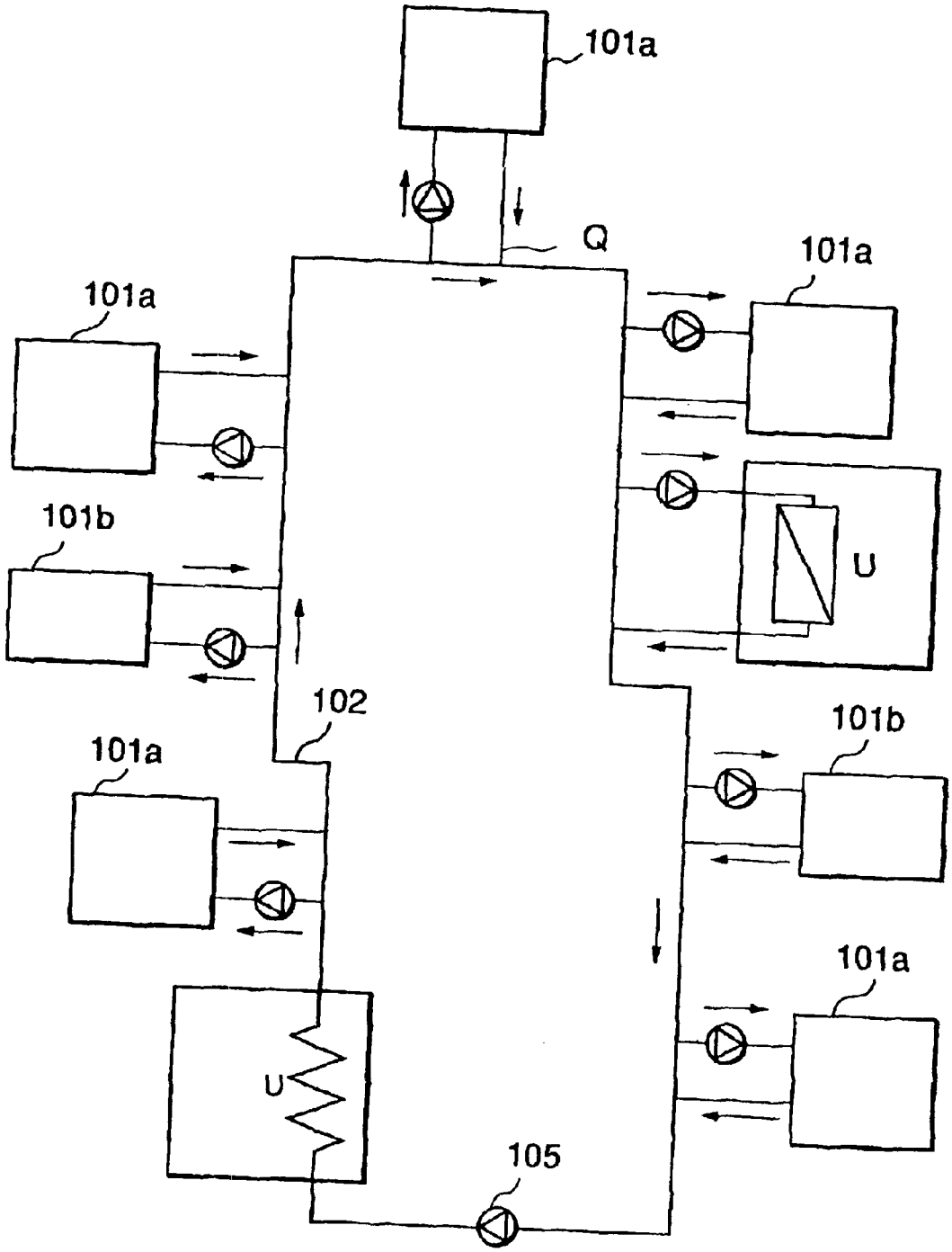
FIG. 11 is a block diagram showing a regional heating and cooling system of prior art.

In each of energy modulation sections 35*a*, 35*b*, 35*c*, 36*a*, 38*a*, and 39*a* in FIG. 9 and 42, 43, and 44 in FIG. 10, when the temperature boundary 20*a* of a helical loop shifts excessively beyond a determined limit range and the helical loop becomes excessively short of lower temperature heat source water, the absorption or adsorption refrigerating machine 17 which has heat conversion function and being operated on the waste heat 16 distributed in the region and a heat exchanger 19 which performs heat exchange between the higher temperature and lower temperature heat source water of helical loops adjacent to each other are utilized, as shown in FIG. 6(A), to cool higher temperature heat source water of an adjacent helical loop taken-in through a bypass pipe 43 and the cooled water is supplied to said helical loop which becomes excessively short of lower temperature heat source water so that inter-region heat supply is performed without a hitch.

The heat pump 19 suppresses exessive increase in lower temperature heat source water in the adjacent duplex helical loop.

Figure 7:
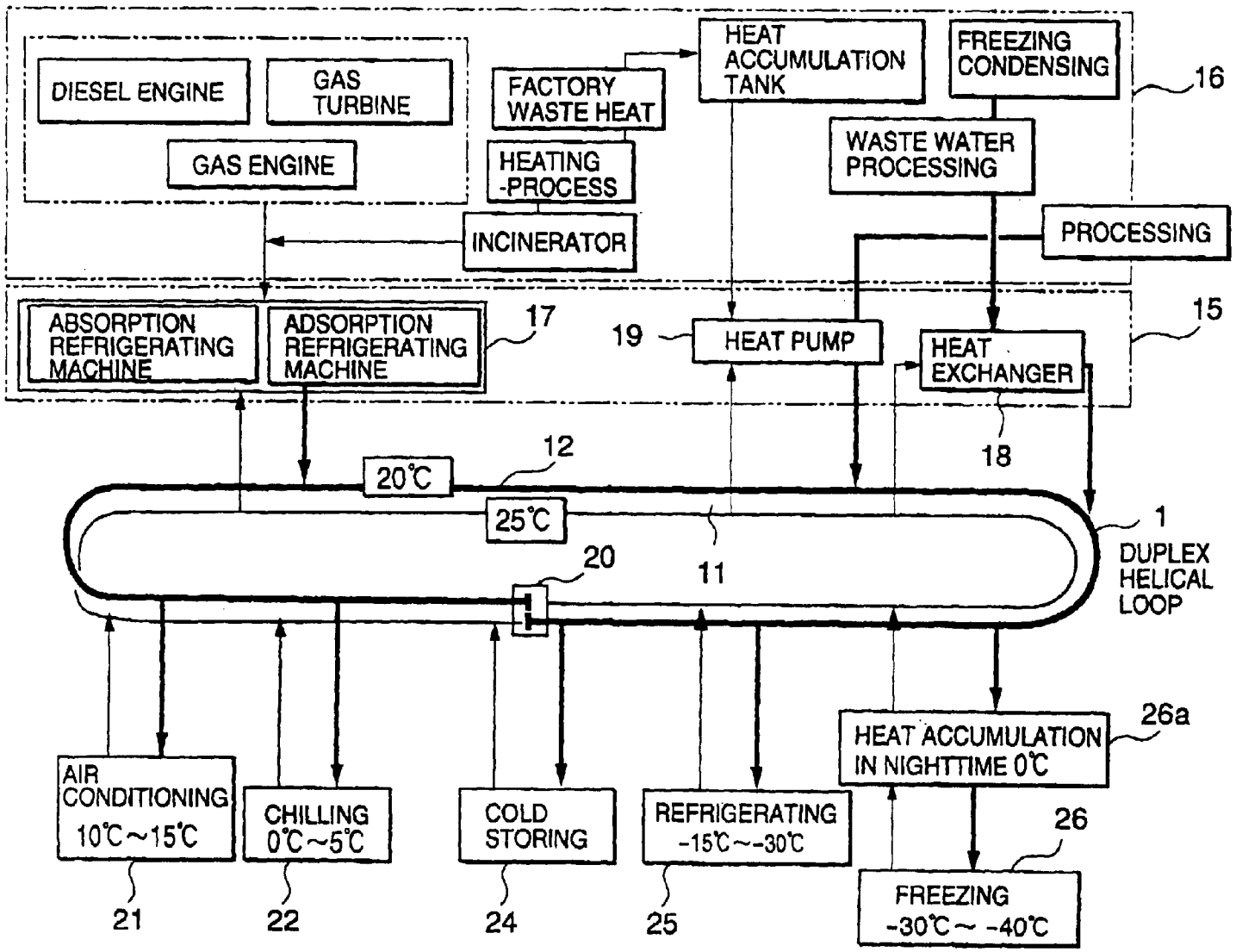
FIG. 7 is an embodiment of the inter-region thermal complementary system of FIG. 5.

FIG. 7 is an embodiment of the inter-region thermal complementary system of FIG. 5. The inter-region thermal complementary system in this case consists of; a duplex helical loop 1 including a higher temperature loop 11, a lower temperature loop 12, and an energy modulation section 20; waste heat 16 discharging apparatuses 16; a heat converting part 15 which supplies lower temperature heat source by utilizing the waste heat discharged from a variety apparatuses 16; and various loads including air conditioning 21, chilling 22, cold storing 24, and refrigerating 25, refrigerating 26 including cryogenic heat accumulation 26*a* during nighttime.

When the most of the loads are cooling/refrigerating loads like this, each load uses a great amount of the lower temperature heat source. To complement the need of this, an absorption or adsorption refrigerating machine 17 is always operated by utilizing the waste heat from the waste heat discharging apparatuses 16 and the higher temperature heat source is cooled and returned to the lower temperature loop side 12.

However, when excess unbalance develops between the higher and lower heat source in spite of the supply of lower temperature heat source, it is modulated by the heat exchanger 17 and heat pump 19 according to the instruction from the energy modulation section 20.

Figure 8:
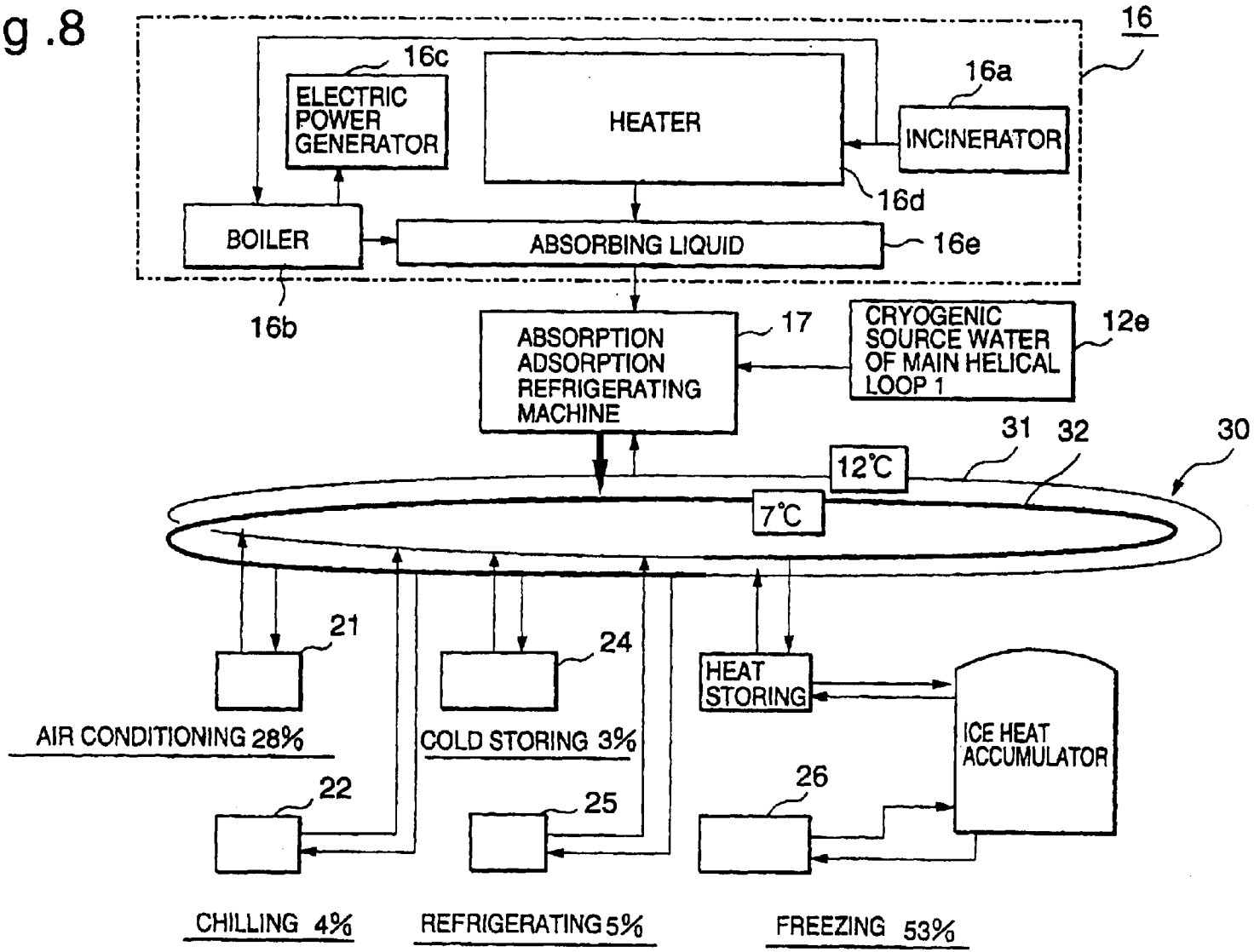
FIG. 8 is an embodiment of the inter-region thermal complementary system of FIG. 5 in a food factory region.

FIG. 8 is an embodiment of the inter-region thermal complementary system of FIG. 5 in a food factory region. In this case of food factories, 28% of the total load is occupied by air conditioning 21, 4% by chilling 22, 3% by cold storing 24, 5% by refrigerating 24, and 53% by freezing 26, for example. The percentage of refrigerating load is very high. To reduce the energy to be used, a sub-duplex helical loop 30 composed of a higher temperature loop 31 filled with relatively higher temperature heat source water of 12° C. and a lower temperature loop 32 filled with relatively lower temperature heat source water of 7° C. are provided in addition to the main helical loop composed of a higher temperature loop of 25° C. and lower temperature loop of 20° C. as used in the case of FIG. 5 and FIG. 7. The provision of the sub-loop 30 like this is limited to the case of the factories of the load characteristic as described above.

The lower temperature heat source water 12*e* of 20° C. in the main loop is cooled by the absorption or adsorption refrigerating machine 17 and supplied to the sub-loop 30.

The process of producing absorbing liquid 16*e* to be used by the absorbing/adsorbing refrigerating machine 17 by utilizing the waste heat 16 discharged from a refuge incinerator 16*a* is depicted in FIG. 8. High temperature combustion gas of the incinerator 16*a* is introduced to a heating device 16*d* and a waste heat boiler 16*b*. Water is heated by the heater 16*d* to obtain absorbing liquid 16*e*. An electric power generator 16*c* is driven by a steam turbine (not shown in the drawing) driven by the steam produced in the boiler 16*b*.

FIG. 9 is an embodiment of the inter-region thermal complementary system of FIG. 5 in the case the object region is extended.

The drawing shows the case when additional main loop II, III, IV, V, VI, VII are laid accompanying the development of regions, and then energy modulation sections 35*a*, 35*b*, 35*c* are provided as necessary between the main loop I and main loop II, IV, and VII respectively to thermally connect them. Energy modulation sections 36*a*, 38*a*, 39*a* are provided between the main loop II and III, between the main loop IV and V, and between the main loop V and VI respectively to thermally connect them. A proper main loop is laid in a region, and additional main loops are laid as the region is developed and extended while connecting two main loops with an energy modulation section. The configuration and function of each energy modulation section is the same as that shown in FIG. 6.

FIG. 10 is an illustration of the case a plurality of regional duplex helical loop 1A, 1B, and 1C of the inter-region thermal complementary system of FIG. 5 are connected in series. Each main loop 1A, 1B, and 1C is connected in series like a chain. The main loop 1A in which a large amount of lower temperature heat source water can be filled is laid in a region where electric power plants and industrial complexes are scattered as large amount of waste heat is generated there. In a region of middle class industrial district is laid the loop 1B in which higher and lower temperature heat source water is filled evenly. The main loop 1C is laid in a region of commercial district where a large amount of lower temperature heat source water is used. The main loop 1A is connected with the main loop 1B by an energy modulation section 42, and the main loop 1B is connected by an energy modulation section 43. An energy modulation section 44 is provided to the main loop 1C. Heat is transferred by way of the energy modulation section 42, 43, and 44 successively and the thermal balance of each loop is achieved.

By connecting helical loops like this, the utilization of existing facilities is possible and heat generated in a region can be transferred to another region.

Effect of the Invention

The inter-region thermal complementary system according to the present invention is constituted as has been described in the foregoing and achieves effects as follows:

(a) By forming a regional piping for supplying heat source water to a region in a loop shape, and supplying said heat source water to refrigerating apparatuses distributed along the regional piping, small scale waste heat from apparatuses distributed at the popular level can be recovered and reused to produce heat source water to be used by heat pumps for air conditioning, and highly efficient heat supply is possible without providing large scale thermal complementary system.

As the heat source water is sealed in a multiplex helical loop shape piping composed of one pipe, the movement of the heat source water in the piping is small, the power for carrying the water is basically not needed, and the total efficiency is raised.

(b) Heat is recovered from the heat sources distributed in the region, the heat obtained through heat conversion is supplied to the multiplex helical loop, for example to the duplex helical loop consisting of higher and lower temperature loop, and the heat sealed in the helical loop is taken-up and discharged to and from the refrigerators distributed along the helical loop, so that it is possible to supply heat to the region without the needs for the power to circulate the heat source water in the helical loop. Further, the higher and lower temperature heat source water kept to constant temperatures of about 25° C. and 20° C. which are lower than the atmospheric temperature in summertime and the water of each temperature is utilized separately, so that the construction cost of the system is reduced and energy consumption is largely decreased.

(c) An energy modulation section is provided to the multiplex helical loop filled with higher and lower temperature heat source water for maintain thermal balance of the water of two temperature zones, the modulation section having heat control function and heat conversion function, so that it is possible to achieve thermal heat balance between helical loops by using the function of the energy modulation section, and to connect thermally a plurality of main helical loops provided in several regions to realize a network connection of the inter-region thermal complementary system.

What is claimed is:

1. An inter-region thermal complementary system consisting of a multiplex helical loop, liquid or slurry like fluid filled in said helical loop being not forcefully circulated by a pump but forming different temperature zones for each component loop, and distributed cryogenic sources and thermal sources being thermally connected to said multiplex helical loop so that the taking-in and discharging of heat are performed between each component loop.

2. The inter-region thermal complementary system according to claim 1, wherein each of said distributed cryogenic sources and thermal sources are thermally connected by way of a bypass pipe and heat conversion means for bypassing the fluid between any two component loops with different temperature among said component loops.

3. The inter-region thermal complementary system according to claim 1, wherein distributed cryogenic source apparatuses and thermal source apparatuses are thermally connected to said multiplex helical loop so that cryogenic or thermal sources are taken-in or discharged between two component loops of different temperature among said component loops by bypassing the fluid between any two component loops of different temperature among said component loops.

4. The inter-region thermal complementary system according to claim 1, wherein the beginning end and termination end of said multiplex helical loop are connected to each other to form a perfectly endless multiplex helical loop.

5. The inter-region thermal complementary system according to claim 1, wherein a water tank is provided straddling the component loops to connect them thereto to form a substantially endless multiplex helical loop.

6. The inter-region thermal complementary system according to claim 1, wherein a relatively higher temperature zone is formed in a component loop and a relatively lower temperature zone is formed in the other component loop in the case said multiplex helical loop is a duplex helical loop.

7. The inter-region thermal complementary system according to claim 1, wherein higher, intermediate, and lower temperature zone are formed successively in each of the component loops in the case said multiplex helical loop is a triplex helical loop.

8. The inter-region thermal complementary system according to claim 3, wherein the heat flow in the bypassing part is allowed to be in one direction according to the purpose the heat source apparatuses connected to the multiplex helical loop is operated.

9. The inter-region thermal complementary system according to claim 1, wherein the temperature boundary zone of each component loop of said multiplex helical loop is bypassed and an energy modulation section is provided at the bypass position for the modulation of thermal unbalance.

10. The inter-region thermal complementary system according to claim 9, wherein said energy modulation section consists of a heat pump or heat exchanger in the inter-region thermal complementary system in which the beginning end and termination end of the multiplex helical loop are connected to each other to be formed in a perfectly endless multiplex helical loop.

11. The inter-region thermal complementary system according to claim 9, wherein said energy modulation section is a water tank straddling the component loops and the relatively higher temperature component loop is connected to the water tank at the upper part thereof and the relatively lower temperature component loop is connected to the water tank at the lower part thereof in the inter-region thermal complementary system in which a water tank is provided straddling the component loops to connect them thereto to form a substantially endless duplex helical loop.

12. The inter-region thermal complementary system according to claim 1, wherein the heat discharged from said distributed heat source apparatuses is cooled by absorption or adsorption refrigerating machines, or heat pumps to be let-in into the relatively lower temperature loop side according to the cooled temperature.

13. The inter-region thermal complementary system according to claim 1, wherein, in the case of duplex helical loop, the duplex helical loop is an ordinary temperature main loop composed of two component loops in which zone temperatures are about 19° C. and 26° C. having temperature difference of about 7° C.

14. The inter-region thermal complementary system according to claim 1, wherein, in the case of the system applied to food factory region, a duplex helical loop composed of a lower temperature component loop of 0° C.~10° C. and a higher temperature component loop of a temperature higher than that of said lower temperature component loop by 5° C.~8° C., which temperatures is achieved by utilizing absorption or adsorption refrigerating machines or heat pumps, is provided as a sub-loop to supplement said ordinary temperature main loop.

15. The inter-region thermal complementary system according to claim 1, wherein a plurality of main helical loops each of which is a duplex helical loop are provided in a plurality of regions, and each of the main helical loops is thermally connected in series and/or in ramified state by an energy modulation section in which heat transfer between each main helical loop is performed, to form a thermally connected chain-like loop group.

16. The inter-region thermal complementary system according to claim 1, wherein the fluid discharged from said distributed heat source apparatuses having higher temperature than that of the fluid in a higher temperature loop is cooled by absorption or adsorption refrigerating machines or heat pumps to be let-in into a lower temperature loop side according to the discharged temperature.

17. The inter-region thermal complementary system according to claim 15, wherein said multiplex helical loop is composed of a plurality of main helical loops provided in each region and each of the main helical loops is thermally connected in series and/or in ramified state through an energy modulation section for performing heat transfer between each main helical loop.

18. The inter-region thermal complementary system according to claim 17, wherein said multiplex helical loop is composed of a main helical loop and a sub-helical loop and the both loops are thermally connected through an energy modulation section for performing heat transfer between the both loops.

19. The inter-region thermal complementary system according to claim 15, wherein each of said energy modulation section has the function of thermally connecting adjacent duplex helical loops by providing to it a heat control means to control the supply of lower temperature heat source fluid or the supply of higher temperature heat source fluid by a heat transferring means or a heat pump located between adjacent duplex helical loops.

* * * * *